US009596736B2

(12) United States Patent
Hinrichs

(10) Patent No.: US 9,596,736 B2
(45) Date of Patent: Mar. 14, 2017

(54) DUAL FUNCTION LIGHT CONTROLLER WITH STAND-ALONE AND PERIPHERAL MODE OF OPERATION

(71) Applicant: MARTIN PROFESSIONAL A/S, Aarhus N (DK)

(72) Inventor: Matthias Hinrichs, Prior Lake, MN (US)

(73) Assignee: MARTIN PROFESSIONAL A/S, Aarhus N (DK)

( * ) Notice: Subject to any disclaimer, the term of this patent is extended or adjusted under 35 U.S.C. 154(b) by 257 days.

(21) Appl. No.: 14/363,160

(22) PCT Filed: Feb. 19, 2013

(86) PCT No.: PCT/DK2013/050043

§ 371 (c)(1),
(2) Date: Jun. 5, 2014

(87) PCT Pub. No.: WO2013/123945

PCT Pub. Date: Aug. 29, 2013

(65) Prior Publication Data

US 2014/0346969 A1 Nov. 27, 2014

(30) Foreign Application Priority Data

Feb. 20, 2012 (DK) ..... 2012 70081

(51) Int. Cl.
*H05B 37/02* (2006.01)

(52) U.S. Cl.
CPC ..... *H05B 37/0254* (2013.01); *H05B 37/02* (2013.01); *H05B 37/0245* (2013.01)

(58) Field of Classification Search
None
See application file for complete search history.

(56) References Cited

U.S. PATENT DOCUMENTS 5,329,431 A 7/1994 Taylor et al.
7,737,819 B2 6/2010 Chansky et al.
(Continued)

FOREIGN PATENT DOCUMENTS

CN 1457221 A 11/2003
CN 18948988 A 1/2007
(Continued)

OTHER PUBLICATIONS

International Search Report for PCT/DK2013/050043, May 17, 2013.
(Continued)

*Primary Examiner* — Dedei K Hammond
(74) *Attorney, Agent, or Firm* — Artegis Law Group, LLP

(57) ABSTRACT

The present invention relates to a dual function light controller for a lighting system comprising a number of light emitting devices. The dual function light controller acts in a stand-alone mode of operation as an independent light controller controlling the lighting system and acts in a peripheral mode of operation act as a peripheral device which at least partially is controlled by a main controller controlling the lighting system. The dual function light controller comprises user switching means enabling a user to switch between the stand-alone mode of operation and the peripheral mode of operation. The present invention relates also to a lighting system comprising such dual function light control device.

20 Claims, 3 Drawing Sheets

(56) References Cited

U.S. PATENT DOCUMENTS

| | | | | |
|---|---|---|---|---|
| 8,066,403 | B2 * | 11/2011 | Sanfilippo | F21S 2/005 362/219 |
| 2003/0151909 | A1 | 8/2003 | Sid | |
| 2005/0253538 | A1 * | 11/2005 | Shah | H05B 37/0272 315/362 |
| 2008/0136334 | A1 | 6/2008 | Robinson et al. | |
| 2009/0085500 | A1 | 4/2009 | Zampini, II et al. | |
| 2009/0167483 | A1 | 7/2009 | Jones et al. | |
| 2009/0278479 | A1 | 11/2009 | Platner et al. | |
| 2011/0175553 | A1 * | 7/2011 | Sampsell | H05B 37/0245 315/312 |

FOREIGN PATENT DOCUMENTS

| | | | |
|---|---|---|---|
| CN | 201153338 | A | 11/2008 |
| CN | 102293059 | A | 12/2011 |
| EP | 0253082 | A2 | 1/1988 |
| WO | 8905421 | A1 | 6/1989 |

OTHER PUBLICATIONS http://web.archive.org/web/20100816004846/http://www.ecolightled.com/downloads/lc_nl_dmx_stick_web.pdf.
http://web.archive.org/web/20100826041538/http://www.ecolightled.com/product/lc_nl_dmx_stick/dmx_led_controls.
http://web.archive.org/web/20110616052224/http://www.nicolaudie.com/downloads/files/datasheet_STICK-COM+. pdf.
http://web.archive.org/web/20090117173041/http://www.nicolaudie.com/downloads/files/ESAPRO_manual.pdf.
http://web.archive.org/web/20090117173100/http://www.nicolaudie.com/downloads/files/brochure_stick.pdf.
http://web.archive.org/web/20110616000055/http://www.nicolaudie.com/en/faqs.htm.
http://web.archive.org/web/20100412135621/http://itunes.apple.com/us/app/stick-remote/id362060202?mt=8&.
http://web.archive.org/web/20100515044531/http://www.arcolis.com/en/software.htm.
http://web.archive.org/web/20100620120245/http://www.arcolis.com/en/products.htm.
http://web.archive.org/web/20110202132300/http://lightingsoft.com/.
http://itp.nyu.edu/shows/thesis2010/wp-content/themes/itpthesis2010/stream/simple_ondemand_player.php?url=http://itp.nyu.edu/thesis/spring2010_archives/BrianKim_ITPThesis2010_Small.mp4 Thesis delivered on 8.00 May 5, 2012, available as streaming video at Tisch School of the art, New York University.
LuminAere DMX Lighting Control for Adobe After Effects, Brian Kim, 3 Interactive Telecommunications Program, Tisch School of the Arts, New York University, 2010.
Danish Search Report for PA 2012 70081, Sep. 10, 2012.
Extended European Search Report Application No. 13752409.6, dated Jan. 20, 2016, 7 pages.

* cited by examiner

DUAL FUNCTION LIGHT CONTROLLER WITH STAND-ALONE AND PERIPHERAL MODE OF OPERATION

FIELD OF THE INVENTION

The present invention relates to a light controller for controlling a lighting system, where the lighting system comprises a number of light emitting devices such as controllable light fixtures, controllable light emitting visual devices and/or controllable display devices adapted to show video content.

BACKGROUND OF THE INVENTION

Light controllers adapted to control a number of light emitting devices in a lighting system are widely known in the field of dynamic light controlling, typically used in connection with entertainment lighting systems.

The light controller acts as the primary controller adapted to send control commands to the light emitting devices in the light systems and can as a consequence be used to create very complex light shows. The light commands can be send automatically to the light emitting devices but can also be executed manually using user input means (like button, slide controllers, rotary button, touch screens or other input devices). The light designers and programmers use also the light controller to program and reprogram sequences of light effects, which is executed during the light shown.

Often lighting systems and light shows are very large and the light designer and programmers thus need to program the light show from different physical locations in order to adjust the light show properly. However in many situations, this is not possible as the light controller often is positioned centrally. Presently this have been solved by providing portable devices, which remotely communicate with the central light controller and thus enables the designers and programmers to program the light show from different physical location. The present setups requires that the entire light show have been properly setup and connected to the main light controller, which result in the fact the light designers and programmers often need to perform their adjustments in very short time. Further there is a tendency that the touring industry has at least two set of equipment in order to setup the touring equipment at the next destination while the show is running at another destination. The light designers then moves the light program between the two destinations using memory means likes storing devices in order to make sure that the last adjustments of the light show are copied to the light controller at the next destination. However upon arrival at the new destination further adjustments need to be performed as early as possible. Another issue is the fact that light shows tend to vary in size and require different levels of computational processing power from the lighting control device. In addition to this often it is desired to have a redundant backup system available in case of a failure of control equipment. Lighting personal needs to provide multiple desks for these different purposes.

Simplified light controllers, which enable persons not trained in light systems to control a light system, are also known. Common for the simplified light controllers is the fact that they comprise a simplified user interface enabling the user to activate a number of preprogrammed dynamic light sequences and/or static light scenes. The preprogrammed dynamic light sequence must be programmed at a light controller or a PC running a programming software and then stored in the simplified light controller, as a consequence the simplified light controllers can only be used to execute the preprogrammed dynamic light sequences and/or static light scenes and it is not possible to reprogram the light show using such devices. The S.T.I.C.K. control keypad provided by Nicolaudie-Sunlite is an example of such simplified light controller and a product brochure and products specification describing the device can be found at:

http://web.archive.org/web/20090117173100/http://www.nicolaudie.com/do wnloads/files/brochure_stick.pdf http://web.archive.org/web/20100816004846/http://www.ecolightled.com/do wnloads/Ic_nl_dmx_stick_web-.pdf Another example of such simplified light controller is the Colorfox VX01 provided by Martin Professional A/S. The colorfox is specifically designed for architectural use with dynamic color changing fixtures. This simple control solution allows users to customize and personalize a variety of architectural lighting settings.

DESCRIPTION OF THE INVENTION

The object of the present invention is to solve the above described limitations related to prior art. This is achieved by a dual function light controller and lighting system as described in the independent claims. The dependent claims describe possible embodiments of the present invention. The advantages and benefits of the present invention are described in the detailed description of the invention.

DETAILED DESCRIPTION OF THE INVENTION

Figure 1:
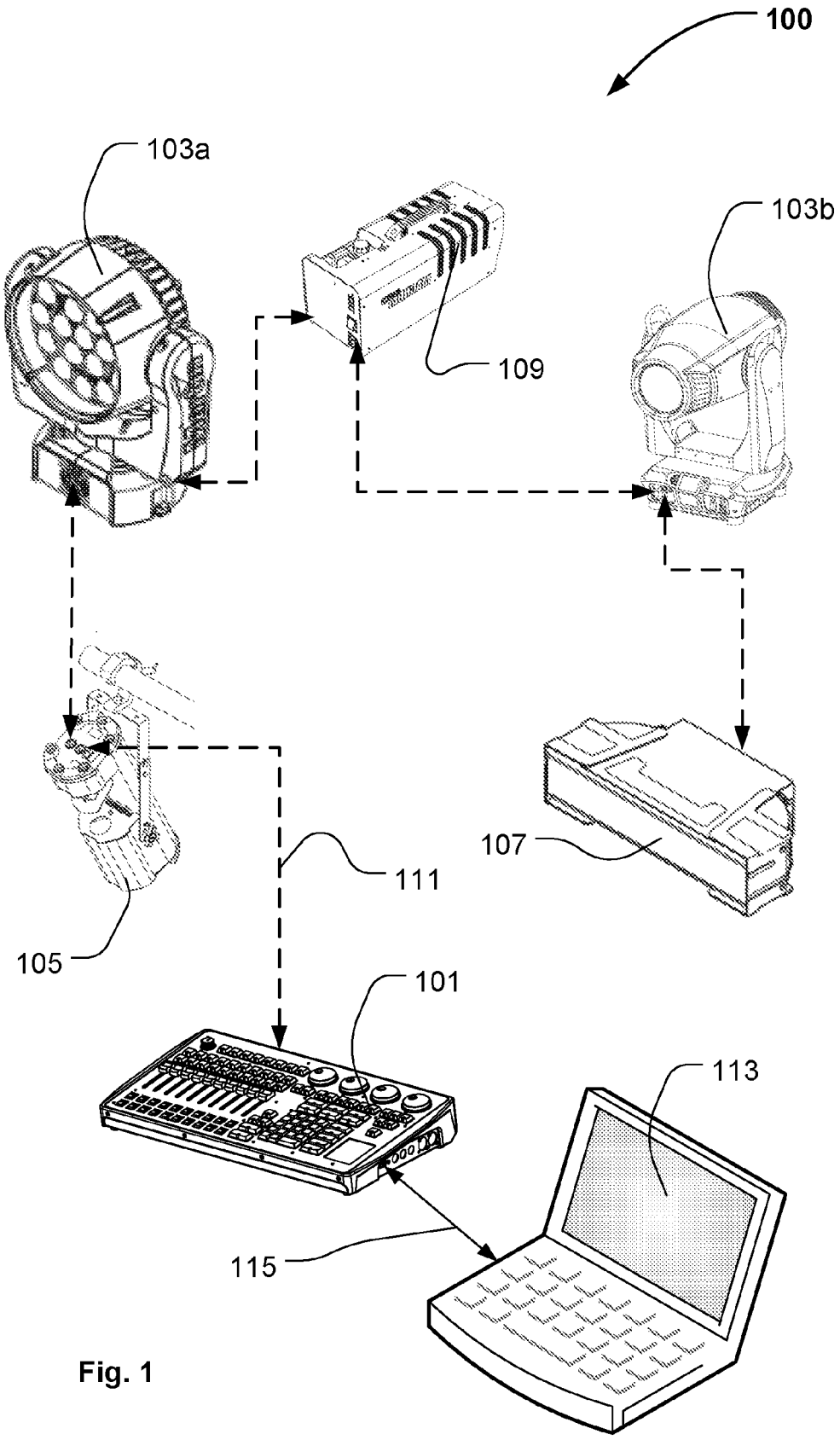
FIG. 1 illustrates a lighting system comprising a dual function light controller according to the present invention.

FIG. 1 illustrates a lighting system 100 comprising a dual function light controller 101 according to the present invention. The lighting system 100 comprises a dual function light controller 101 connected to a number of light effect devices such as moving heads 103*a* and 103*b*, scanners 105, LED light bars 107 or any other controllable light fixtures, controllable light emitting visual devices or controllable display devices adapted to emit video. Further a number of smoke/fog/haze generators 109 can also be a part of the lighting system. The light controller 101 controls the light effects apparatus and smoke generators using a light control signal 111 (illustrated in dashed lines) as known in the art of entertainment lighting systems. In the illustrated embodiment the control signal is a DMX and/or RDM signal and the light emitting devices of the lighting system is daisy chained. However it is to be understood that splitters as known in the art of entertainment lighting systems can be used to create different and sub chains. Further the light controller can control multiple number universes (different chains). The light control signal can for instance be based any standard light control protocols such as DMX, ESTA ACN (Architecture for Control Networks—ANSI E1.17—2006), DMX refers to any of the standards known in the art such as USITT DMX 512, USITT DMX 512 1990, USITT DMX 512-A and DMX-512-A including RDM, as covered by ANSI E1.11 and ANSI E1.20 standards. The light control signal can also be web based, whereby the light devices can be controlled through the internet, LAN or WLAN, such as ArtNET or ArtNetII protocols from Artistic License.

The dual function light controller 101 can be used during the programming of the light show and to execute the light show. The dual function light controller 101 can thus be used as a stand-alone device from which the lighting system can be controlled and programmed. Further the dual function light controller can also be connected to a main controller 113 as illustrated by solid arrow 115 and act as a peripheral device at least partially controlled by the main controller 113. In the illustrated embodiment the main controller is embodied as a PC running a light controlling software capable of controlling the light system 100 through the dual function light controller 101 when the dual function lighting device is peripheral mode of operation and acts as a peripheral device. It is also to be understood that the main controller 113 also can be embodied as any light controller or media server known in the art of entertainment lighting industry. The dual function light controller 101 comprises user switching means capable of switching the dual function light controller between the stand-alone mode of operation and the peripheral mode of operation. In the stand-alone mode of operation the dual function light controller acts as a stand-alone device capable of controlling and programming the light show, and in peripheral mode of operation the dual function light controller acts as a peripheral device connected to a main controller. The dual function light controller according to the present invention make it possible to create a dual function light controller which can be used to program and execute the light show and also can be connected to main controller and acts as input device. The dual function light controller can be embodied as a small controller which the light designer/programmer easily can bring between different destinations while touring with a light show. This is useful in connection with many light shows as the light designer/programmer can use the dual function light controller to performing minor adjustment to the light show and then transfer the minor adjustments to a main controller wherefrom the light show is executed. This make it possible to perform adjustments of the light show even before the entire light show rig have been set up, as the dual function light controller can be used to perform minor adjustments of parts of the light show. Additionally the dual function light controller can be used to program or adjust parts of the light rig which is not visible from the main controller as the adjustments can be performed from and store in the dual function light controller and transferred to the main light controller when the two controllers are connected. The dual function light controller is further very useful in connection with a PC as a standard PC does not comprise output ports for light protocols and the light controller can be connected to the PC (for instance through the USB port or other communication ports) and adapted to convert control signals into a standard light protocol. Further the light controller can act as an input device to a PC acting a main controller, whereby additional input devices often used in light controllers can be added to the PC. The dual function light controller can use its' internal processing means when controlling a light show, but can switch to external processing means if more processing power is needed. Also it can switch to external processing means (peripheral mode of operation) in case the internal processing means fails. The memory of the dual function light can further be adapted to function as backup of the light show.

The user switching means makes the user cable of determine which mode of operation that the dual function light controller must be in. This give the user full control of how he/she want to use the dual function light controller which is useful as the user typical has his/her own way of setting up and controlling the light system.

In peripheral mode of operation all human interface controls like sliders, encoders etc. and all IO data input for lighting data such as MIDI signal and timecode signals can be routed to the main light controller. Further included hardware encryption devices that influence the software license available for the main light controller can be transferred to the main light controller. The internal processing means of the dual function light controller can in peripheral mode of operation be turned off in order to save power.

The dual function light controller makes it thus possible to provide a very flexible and scalable light controller which can be used for varying sizes of light shows.

Figure 2:
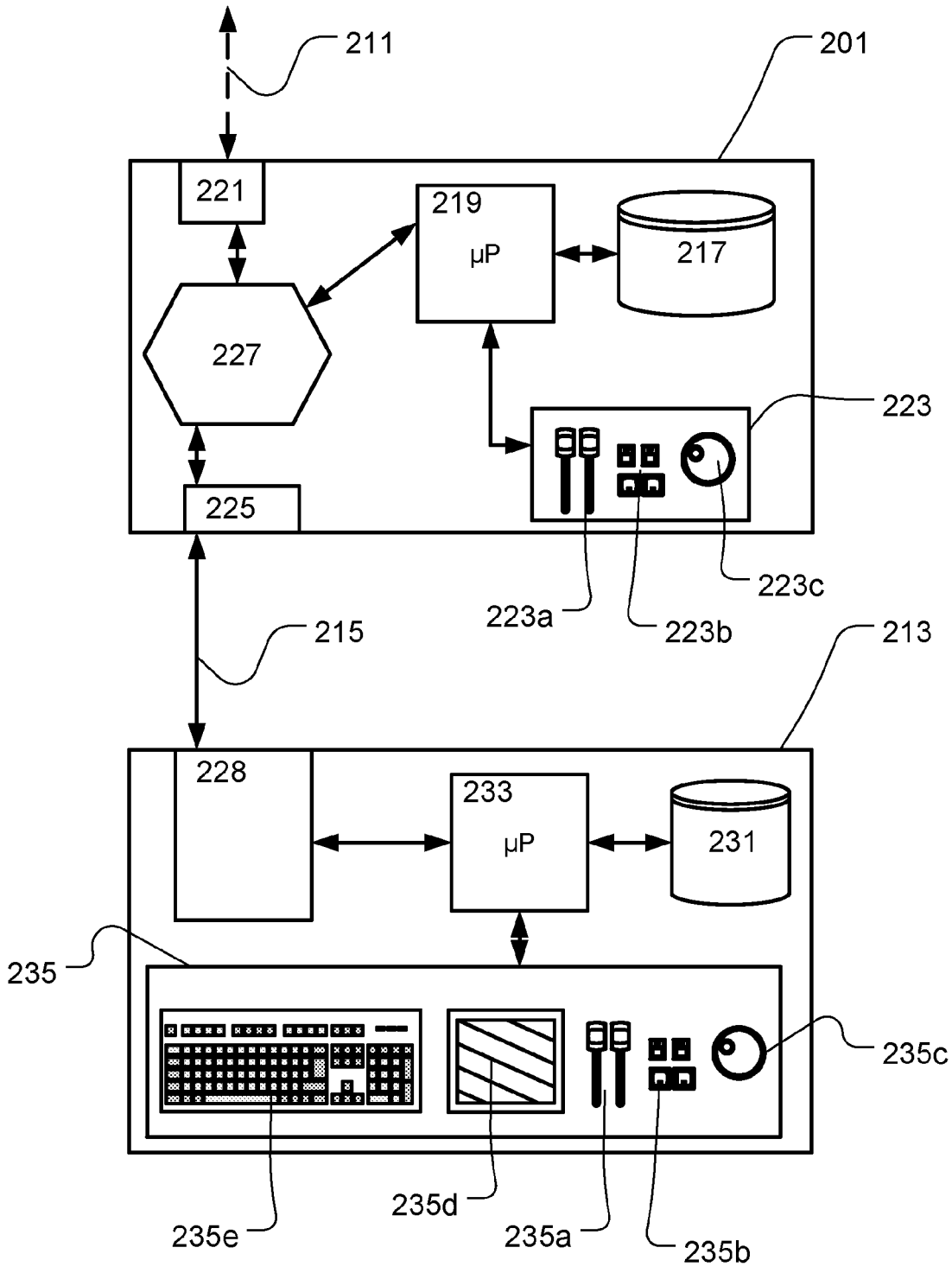
FIG. 2 illustrates a structural diagram of a dual function light controller according to the present invention.

FIG. 2 illustrates a structural diagram of a dual function light controller 201 according to the present invention. In the illustrated embodiment the dual function light controller is connected to a main light controller 213. However both the stand-alone and peripheral mode of operation are described in connection with FIG. 2.

The dual function light controller light controller 201 comprises memory means 217 wherein a number of control commands associated with at least one of the light emitting devices in the lighting system are stored. The control commands can be any control command known in the art of entertainment lighting and can for instance be commands used to control different parameters of the light emitting devices such as pan and tilt movement of a moving head and/or scanning mirror, the color or intensity of the generated light, various light effects such as gobo, animation, iris, framing or prism effects. The control commands can also be macros or cues defining different lighting scenes and which can control a multiple number of the lighting devices. Processing means 219 is adapted to send light control commands to the light emitting devices based on the control commands stored in the memory using the first communication means 221. The communication means 221 is adapted to send the light control commands to the light emitting devices through a standard lighting protocol 211, whereby the light emitting devices acts as instructed. Some lighting protocols such as RDM enables also the light emitting devices to return responses to the light controller and the first communication means 221 is thus also capable of receiving such responses and send these to the processing means for evaluation.

The processing means can further be adapted to send the light control commands based on a predefined execution schema (cue list) also stored in the memory and/or based on user input received through user input means 223. The processing means can also be adapted to control the light control commands based on other input signals such as music signals (MIDI) or other trigger signals (Time code signals). The user input means 223 can comprise a number of user input means such as slide controllers 223*a*, buttons 223*b*, rotary button 223*c*, touch screens (not shown, track balls (not shown), joysticks (not shown), motion sensors, keyboard (not shown) or other input device. Further the dual function light controller can comprise indication means for showing information to the user. For instance the indication means can be indication lamps (e.g. LEDs) or display means, such and screens and/or monitors. The indication means can be integrated into the dual function light controller, but can also be provided as external means such as an external monitor, which is connected to the dual function light controller.

The dual function light controller 201 comprises also programming means adapted to create edit the control commands based on user inputs received through the user input means. The programming means enables a user to create new control commands and stores the new control commands in the memory 217. Further the programming means enables a user to edit an existing control command and store the edited control command in the memory for instance by overwriting the original control command or by storing the edited control command as a new control command.

The dual function light controller comprises also second communication means 225 adapted to communicate 215 with a main light controller 213. The main light controller comprises main communication means 228, main memory means 231, main processing means 233 and main user input means 235. The main processing means 233 is adapted to communicate with the dual function light controller 201 using the main controlling means 228 and the second communications means 225 of the dual function light controller. This communication can be based on any means capable of providing data communicating between the dual function light controller and the main light controller and can for instance be a USB connection, IR connection, Bluetooth connection, internet connection, LAN/WAN connection or any other data connection enabling communication between the light controller 201 and the main light controller 213. It is also possible to provide a multiple number of second communication means as main communication means for instance in order to enable data communication based on two different protocols. For instance both an USB connection and a LAN connection can be embodied in the controllers at the same time. The main memory 231 can also comprise a number of control commands associated with at least one the light emitting devices. The main user input means 235 can comprise a number of user input means such as slide controllers 235*a*, button 235*b*, rotary button 235*c*, touch screens 235*d*, track balls (not shown), joysticks (not shown), motion sensors, keyboard 235*e* or any other input device. Further the main light controller can comprise indication means for showing information to the user. For instance the indication means can be indication lamps (e.g. LEDs) or display means, such and screens and/or monitors. The indication means can be integrated into the main light controller, but can also be provided as external means such as an external monitor, which is connected to the main light controller.

The main light controller 213 comprises also main programming means adapted to create and edit control commands based on user inputs received through the main user input means 235. The main programming means enables a user to create new control commands and stores the new control commands in the main memory 231. Further the main programming means enables a user to edit an existing control command and store the edited control command in the main memory by overwriting the original control command or by storing the edited control command as a new control command.

The dual function light control 201 comprises also user switching means 227 capable of switching the dual function light controller 201 between a stand-alone mode of operation and a peripheral mode of operation. The user switching means 227 are activated by a user operating the dual function light controller. In the stand-alone mode of operation the light controller acts as an independent light controller where the processing means 219 controls and sends light control commands to the light emitting devices based on the control commands stored in the memory 217 by using the first communication means 221. In the stand-alone mode of operation the light controller 201 does not need to be connected to a main controller in order to send light control commands to the light emitting devices. A user can thus execute and program a light show using the dual function light controller as the only light controlling device. Further the processing means can send light control commands to the lighting devices based on user input provide through the user input means 223.

In the peripheral mode of operation the dual function light controller 201 is connected to a main light controller 213 and allows the main controller 213 to send a number of light control commands to the light emitting devices using the first communication means 221, the second communication means 225 and the main communication means 228. The dual function light controller 201 receives a number of commands from the main light controller, these commands are indicative of the light control commands that the main light controller 213 wants to send to the light emitting devices. The commands indicative of the light control commands can for instance be control commands which in the dual function light controller 201 are send directly from the second communication means 225 via the first communication means 211 and to the light emitting devices. Alternatively the commands indicative of the light control commands can be instructions to the processing means 219 of the dual function light controller 201 to send light control commands to the light emitting devices based on control commands stored in the memory 217. The dual function light controller acts thus as a peripheral device which is partially controlled by the main controller and adapted to send light control commands to the light emitting devices from the main light controller 213.

In one embodiment and in peripheral mode of operation the processing means 219 is prevented from sending light control commands to the light emitting devices through the first communication means 221 without permission from the main controller 213. Hereby it can be avoided that conflicting light control commands can be send to the light emitting devices as the main processing means 233 of the main light controller 213 acts as a primary processor.

The processing means 219, first communication 221 means, second communication means 225 are shown as individual parts, however the skilled person realize that they can be integrated into the same logic device or microprocessor. Similar the switching means 227 is illustrated as an individual part, however it is to be understood that the switching means also can be integrated into the same logic devise as the other components.

The user switching means 227 can be activated by a user and comprises user input means such as a button or switch enabling a user manually to toggle the dual function light controller 201 between the stand-alone mode of operation and the peripheral mode of operation. The user input means activating the user switching means can also be integrated in a graphical user interface shown at a display unit integrated in or connected to the dual function light controller.

The switching means can be embodied in the program running on the processing means 219 and be integrated as a part of the software, such that the processing means 219 in the peripheral mode of operation is adapted to direct and convert control commands send by the main light controller 213 to light control commands and send these to the light emitting devices using the first communication means 221. Alternatively the switching means can be a physical or logic switch which changes the electric and/or logic circuits of the dual function light controller such that control commands received from the main light controller (through the second communication means) is directed to a signal converter which converts the received control commands into light commands according the light protocol 211. The circuit can also be rerouted such that signal from the user input means 223 are rerouted directly to the main controller through the second communication means and main communication means and where the processing means of the main controller is adapted to receive the inputs from the input means.

Figure 3:
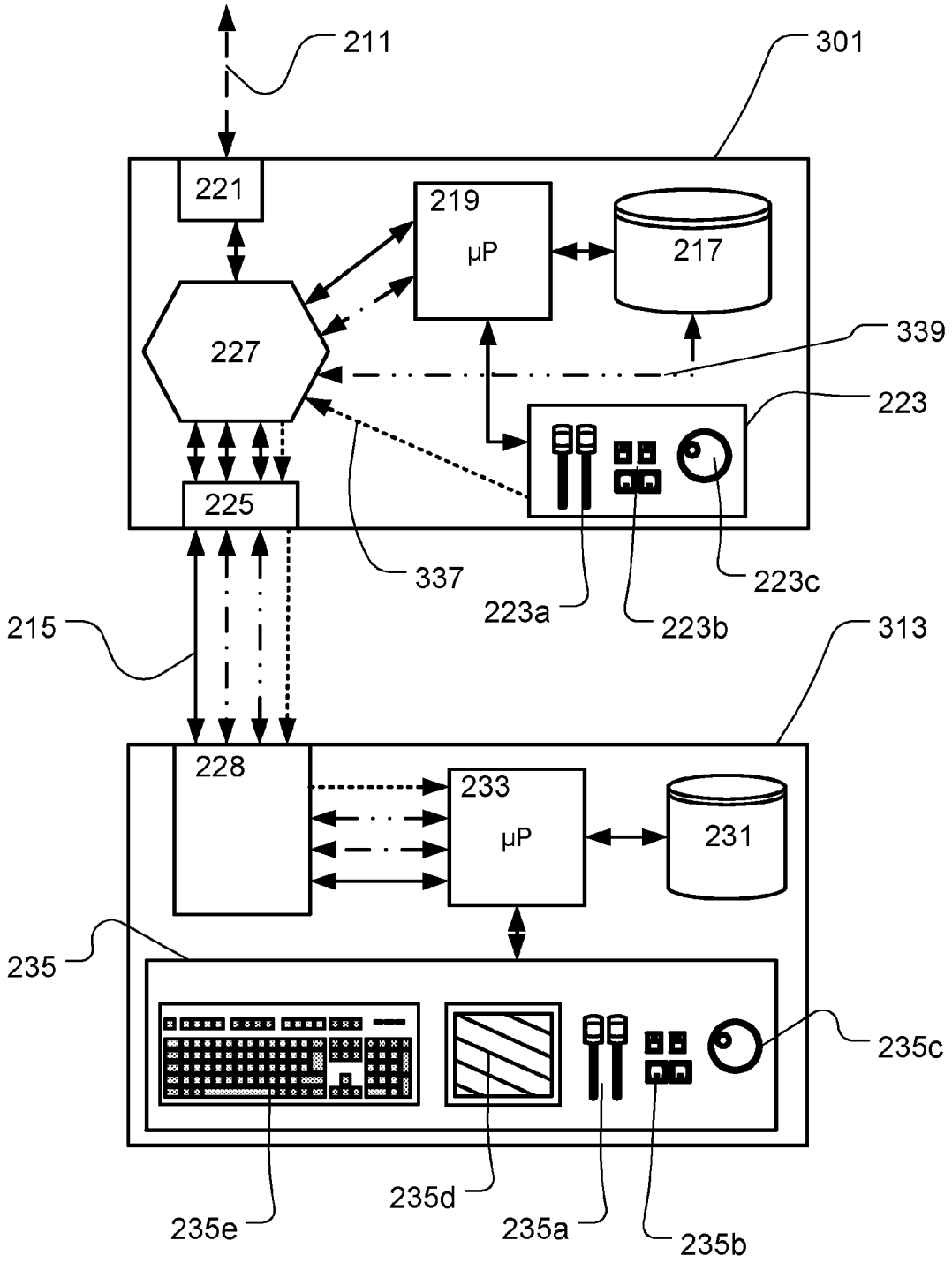
FIG. 3 illustrates a structural diagram of a dual function light controller according to another aspect of the present invention.

FIG. 3 illustrates a structural diagram of a dual function light controller 301 according to the present invention. In the illustrated embodiment the dual function light controller is connected to a main light controller 313. The dual function light controller 301 and the main light controller 313 are substantially identical to the dual function light controller 201 and main light controller 213 shown in FIG. 2 and substantially identical components have the same reference numbers and are described in connection with FIG. 2.

In this embodiment and in the peripheral mode of operation the dual function light controller 301 is adapted to communicate (illustrated by dotted arrows 337) user input from the input means 223 to the main light controller 313 through the second communication means 225 and the main communication means 228. This make it possible to use the user input means 223 at the dual function light controller 301 as additional input means to the main controller 313 and let the main light controller associate control commands to the user input means 223. The main processing means 233 can thus be adapted to send a light control commands the light emitting devices using the main communication means 228, second communication means 228 and first communication means 221 and based on user input signals from the input means 223 of the dual function light controller 301. As illustrated the switching means can be adapted to send the input signals from the user input means 223 directly to the main light controller 313, however the skilled person realize that the user input means also can be directed to the main light controller 213 via the processing means 219 of the dual function light controller 301.

In one embodiment and in the peripheral mode of operation the all necessary IO (from user input means, MIDI signals, time code signals) ports of the dual function light controller is sent the main controller by rerouting the hardware/software encryption mechanism and also turns off the processing means of the dual functional light controller.

In the illustrated embodiment and in the peripheral mode of operation the dual function light controller 301 is adapted to allow (illustrated by dashed-dotted-dotted arrows 339) the main light controller 313 to access the memory means 217 using the second communication means 225 and the main communication means 228. This makes it possible for the main light controller 313 to access control commands stored in the memory means 217 of the dual function light controller 301. This is useful in a situation where the dual function light controller 301 has been used to perform adjustments of the light systems and where the main controller need to access these adjustments when executing the light show. Further this makes it possible to use the dual function light controller 301 as backup of the light show, as the main light controller can access the light show in the memory means 217. The switching means 227 can be adapted to give the main light controller 301 direct access to the memory means 217 but the access can also be given through the processing means 219 of the dual function light controller. For instance by setting up a client-server like system where the main controller 313 requests information at the dual function light controller 301 and where the dual function light controller creates responses based on the requests.

In the illustrated embodiment and in the peripheral mode of operation the dual function light controller is adapted to allow (illustrated by dashed-dotted arrows 339) the main light controller to distribute processing tasks to the processing means 219 of the dual function light controller 301. The main processer can then use the processing means 219 of the dual function light controller 301 as additional processing power. It is to be understood that the opposite situation where the dual function light controller uses the main processing means of the main light controller as extra processing power. Further the main light controller 313 can allow the dual function light controller 301 to automatically execute a part of the light show while another part of the light is reprogrammed at the main light controller. This makes is possible to perform adjustments of the light shown while executing the light show. The opposite situation where the light show is executed through the main light controller and reprogrammed using the light controller 201 is also possible.

In one embodiment the dual function light controller comprises synchronization means (not shown) adapted to send and/or receive synchronization data to/from the main light controller. The synchronization means can be embodied as a process executed by the processing means 219 and the processing means can be adapted to send and receive the synchronization data to and from the main controller 313 through the second communication means 225. The synchronization data is indicative of at least one of the control commands and/or at least one parameter related to at least one of the control commands. The synchronization data can be indicative of entire control commands, parts of control commands, changes applied to control commands. Parameters related to control commands can be any parameter related to a control command for instance clock and/or time data indicative a time parameter related to the execution of the control commands. This makes it possible to synchronize the control commands at the dual function light controller and the main light controller. It is notice that the main light controller also comprises synchronization means enabling the synchronization. This is useful in the case where the dual function light controller have been used to program and/or reprogram a light show and where the main controller is used to execute the light show as the part of the light show programmed at the dual function light controller easily can be synchronized with the main light controller. It is to be understood that the opposite case, where the control commands stored at the dual function light controller are synchronized with the content of the main controller, also is possible.

Further in situations where the dual function light controller and the main light controller are used by two different operators to program different parts of the light show at the same time, the synchronization means makes it also possible to synchronize the content programmed by the two operators. This is possible as the dual light controller in standalone mode of operation can be used as an independent light controller and can thus be used to program at light show while another operator programs the light show at the main controller.

Additionally the synchronization means can be used to synchronize the dual function light controller and the main light controller while executing the light show from one of the light controllers. As a consequence both the light controllers will know how much of the light show that have been executed and which light commands which are programmed to be executed next. Together with the user switching means of the dual function light controller the synchronization means makes it possible to connect the main controller and the dual light controller to the same light systems and let one of the controllers acts as a backup controller, which immediately can take over the control of the light show without the need to restart or reboot the light system.

The synchronization means can be adapted to exchange the synchronization data at regular time intervals which ensures that the dual function light controller and main light controller are synchronized at regular bases. The time intervals can be very short resulting in a live synchronization between the two controllers. Also the synchronization means can be adapted to exchange the synchronization data when one of the light control commands is sent to the light emitting devices. The synchronization means can also be adapted to exchange the synchronization data when one of the number of control commands and/or when one parameter related to at least one of the number of control commands has been changed. This makes it possible to synchronize the dual function light controller and main light controllers at different events and time which ensures a robust synchronization.

For instance the light show can be executed using the main controller and the dual function controller in peripheral mode of operation, where the main controller performs the execution of the light show and where the dual function controller acts as input device to the main controller. In the case that the main controllers fails or crashes the operator can very fast switch the dual function controller from peripheral mode of operation to stand-alone mode of operation whereby the dual function light controller takes over the execution of the light show. This is possible as the synchronization means ensures that the dual function light controller is synchronized with the main controller and thus at the time of switching knows the time position of the light show. The opposite situation, where the light show first are controlled by the dual function light controller and where the main light controller acts as backup controller, is also possible. In fact in an embodiment where the processor 219 of the dual function light controller is turned off (in order to save power) in the peripheral mode of operation, this setup may be preferred as the startup of the processor is then not need when switching controller.

The synchronization means makes it also possible to execute the light show at one of the controllers and at the same time program another part of the light show using the other light controller.

It is also possible to connect two or more dual function light controllers where one of the dual function light controllers are adapted to acts as main light controller. The dual function light controller makes it thus possible to provide a very flexible and scalable light controller which can be used for varying sizes of light shows.

What is claimed is:

1. A dual function light controller for controlling a lighting system, where said lighting system comprises a number of light emitting devices, said dual function light controller comprising:

a memory device adapted to store a number of control commands associated with at least one of said light emitting devices;

a first communication device adapted to send light control commands to said light emitting devices;

a processing device adapted to send said light control commands to said light emitting devices based on said control commands using said first communication device;

a second communication device adapted to communicate with a main light controller; and a user input adapted to receive user input from a user, said user input comprises a user switching device for switching said dual function light controller between a stand-alone mode of operation and a peripheral mode of operation, wherein said dual function light controller in said stand-alone mode of operation acts as an independent light controller sending said light control commands to said light emitting devices and where said dual function light controller in said peripheral mode of operation is adapted to communicate with a main light controller using said second communication device and is at least partially controlled by said main light controller, wherein said dual function light controller in said peripheral mode of operation is adapted to allow said main light controller to use said first communication device to send a number of light control commands to said light emitting devices.

2. A dual function light controller according to claim 1 wherein said user switching device comprises at least one physical input device adapted to toggle said dual function light controller between said stand-alone mode of operation and said peripheral mode of operation.

3. A dual function light controller according to claim 1 wherein said user switching device comprises a graphical input device embodied as a part of a graphical user interface displayed at a display unit, said graphical input device being adapted to toggle said dual function light controller between said stand-alone mode of operation and said peripheral mode of operation.

4. A dual function light controller according to claim 1 wherein said dual function light controller in said peripheral mode of operation is adapted to communicate user input from said user input to said main light controller using said second communication device.

5. A dual function light controller according to any claim 1 wherein said dual function light controller in said peripheral mode of operation is adapted to allow said main light controller to access said memory device using said second communication device.

6. A dual function light controller according to claim 1 wherein said dual function light controller in said peripheral mode of operation is adapted to allow said main light controller to distribute processing tasks to said processing device.

7. A dual function light controller according to claim 1 wherein said dual function light controller comprises a synchronization device adapted to send and/or receive synchronization data to/from said main light controller using said second communication device, where said synchronization data being indicative of at least one of said number of control commands and/or at least one parameter related to at least one of said number of control commands.

8. A dual function light controller according to claim 7 wherein said synchronization device is adapted to send and/or receive said synchronization data at regular time intervals.

9. A dual function light controller according to claim 7 wherein said synchronization device is adapted to send said synchronization data at when said processing device sends at least one of said light control commands to said light emitting devices.

10. A dual function light controller according to claim 7 wherein said synchronization device is adapted to send said synchronization data when at least of at least one of said number of control commands and/or at least one parameter related to at least one of said number of control commands has been changed.

11. A lighting system comprising:

a number of light emitting devices;

a main light controller comprising:

a main processing device;

a main communication device; and a main memory device adapted to store a number of control commands associated with at least one of said light emitting devices; and a dual function light controller comprising:

a memory device adapted to store a number of control commands associated with at least one of said light emitting devices;

a first communication device adapted to send light control commands to said light emitting devices;

a processing device adapted to send said light control commands to said light emitting devices based on said control commands using said first communication device;

a second communication device adapted to communicate with said main light controller through said main communication device;

a user input adapted to receive user input from a user, wherein said user input comprises a user switching device for switching said dual function light controller between a stand-alone mode of operation and a peripheral mode of operation;

wherein said dual function light controller in said stand-alone mode of operation acts as an independent light controller sending said light control commands to said light emitting devices and where said dual function light controller in said peripheral mode of operation is connected to said main light controller and is at least partially controlled by said main light controller, wherein said dual function light controller in said peripheral mode of operation is adapted to allow said main light controller to use said first communication device to send a number of light control commands to said light emitting devices.

12. A lighting system to claim 11 wherein said dual function light controller in said peripheral mode of operation is adapted to communicate user input from said user input to said main light controller using said second communication device and said main communication device.

13. A lighting system according to claim 11 wherein said dual function light controller in said peripheral mode of operation is adapted to allow said main light controller to access said memory device using said second communication device and said main communication device.

14. A lighting system according to claim 11 wherein said dual function light controller in said peripheral mode of operation is adapted to allow said main light controller to distribute processing tasks to said processing device.

15. A lighting system according to claim 11 wherein said lighting system comprises a synchronization device, where said synchronization device is adapted to exchange synchronization data between said dual function light controller and said main light controller, said synchronization data being indicative of at least one of said number of control commands and/or a parameter related to said control commands.

16. A lighting system according to claim 15 wherein said synchronization device is adapted to exchange said synchronization data at regular time intervals.

17. A lighting system according to claim 15 wherein said synchronization device is adapted to exchange said synchronization data when at least one of said light control commands is sent to said light emitting devices.

18. A lighting system according to claim 15 wherein said synchronization device is adapted to exchange said synchronization data when at least one of said number of control commands and/or at least one parameter related to at least one of said number of control commands has been changed.

19. A dual function light controller for controlling a lighting system, where said lighting system comprises a number of light emitting devices, said dual function light controller comprising:

a memory device adapted to store a number of control commands associated with at least one of said light emitting devices;

a first communication device adapted to send light control commands to said light emitting devices;

a processing device adapted to send said light control commands to said light emitting devices based on said control commands using said first communication device;

a second communication device adapted to communicate with a main light controller; and a user input adapted to receive user input from a user, said user input comprises a user switching device for switching said dual function light controller between a stand-alone mode of operation and a peripheral mode of operation, wherein said dual function light controller in said stand-alone mode of operation acts as an independent light controller sending said light control commands to said light emitting devices and where said dual function light controller in said peripheral mode of operation is adapted to communicate with a main light controller using said second communication device and is at least partially controlled by said main light controller, wherein said dual function light controller further comprises a synchronization device adapted to send and/or receive synchronization data to/from said main light controller using said second communication device, said synchronization data being indicative of at least one of said number of control commands and/or at least one parameter related to at least one of said number of control commands, wherein said synchronization device is further adapted to send and/or receive said synchronization data at regular time intervals.

20. A lighting system comprising:

a number of light emitting devices;

a main light controller comprising:

a main processing device;

a main communication device; and a main memory device adapted to store a number of control commands associated with at least one of said light emitting devices; and a dual function light controller comprising:

a memory device adapted to store a number of control commands associated with at least one of said light emitting devices;

a first communication device adapted to send light control commands to said light emitting devices;

a processing device adapted to send said light control commands to said light emitting devices based on said control commands using said first communication device;

a second communication device adapted to communicate with said main light controller through said main communication device;

a user input adapted to receive user input from a user, wherein said user input comprises a user switching device for switching said dual function light controller between a stand-alone mode of operation and a peripheral mode of operation;

wherein said dual function light controller in said stand-alone mode of operation acts as an independent light controller sending said light control commands to said light emitting devices and where said dual function light controller in said peripheral mode of operation is connected to said main light controller and is at least partially controlled by said main light controller, wherein said lighting system further comprises a synchronization device, where said synchronization device is adapted to exchange synchronization data between said dual function light controller and said main light controller, said synchronization data being indicative of at least one of said number of control commands and/or a parameter related to said control commands, wherein said synchronization device is further adapted to exchange said synchronization data at regular time intervals.

* * * * *